US009406473B2

(12) United States Patent
Cho

(10) Patent No.: US 9,406,473 B2
(45) Date of Patent: Aug. 2, 2016

(54) CIRCUIT BREAKER TERMINAL SHIELD

(71) Applicant: LSIS CO., LTD., Anyang-si, Gyeonggi-do (KR)

(72) Inventor: Seong Yeol Cho, Cheongju-si (KR)

(73) Assignee: LSIS CO., LTD., Anyang-si (KR)

( * ) Notice: Subject to any disclaimer, the term of this patent is extended or adjusted under 35 U.S.C. 154(b) by 9 days.

(21) Appl. No.: 14/495,031

(22) Filed: Sep. 24, 2014

(65) Prior Publication Data

US 2015/0122626 A1 May 7, 2015

(30) Foreign Application Priority Data

Nov. 6, 2013 (KR) ..... 10-2013-0134335

(51) Int. Cl.

| | |
|---|---|
| ***H01H 9/02*** | (2006.01) |
| ***H01H 71/02*** | (2006.01) |
| ***H01H 71/08*** | (2006.01) |
| ***H01H 9/34*** | (2006.01) |

(52) U.S. Cl.

CPC ..... *H01H 71/025* (2013.01); *H01H 9/0264* (2013.01); *H01H 9/342* (2013.01); *H01H 71/08* (2013.01)

(58) Field of Classification Search

CPC ..... H01H 9/34; H01H 9/341; H01H 9/342; H01H 9/30; H01H 9/302; H01H 9/305

USPC ..... 200/304, 306; 335/201, 202; 218/156, 218/157, 158, 77

See application file for complete search history.

(56) References Cited

U.S. PATENT DOCUMENTS

| | | | | |
|---|---|---|---|---|
| 3,582,966 | A | 6/1971 | Strobel | |
| 5,488,337 | A | 1/1996 | Hubbard et al. | |
| 6,211,759 | B1 | 4/2001 | Little et al. | |
| 6,407,354 | B1 | 6/2002 | Turner et al. | |
| 6,930,577 | B2 | 8/2005 | Subramanian et al. | |
| 8,169,283 | B2 * | 5/2012 | Siebels | H01H 9/0264 335/202 |
| 2005/0057333 | A1 | 3/2005 | Subramanian et al. | |

FOREIGN PATENT DOCUMENTS

| | | |
|---|---|---|
| CN | 102792403 A | 11/2012 |
| EP | 2383760 | 11/2011 |
| JP | 62-012244 | 1/1987 |
| JP | 05-190075 | 7/1993 |
| JP | 05-342974 | 12/1993 |
| JP | 07-176257 | 7/1995 |
| JP | 09-507337 | 7/1997 |
| JP | 2005-216716 | 8/2005 |
| JP | 2013-223962 | 10/2013 |
| WO | 2011/109497 | 9/2011 |

OTHER PUBLICATIONS

Japan Patent Office Application Serial No. 2014-214379, Office Action dated Jun. 30, 2015, 3 pages.

(Continued)

*Primary Examiner* — Vanessa Girardi

(74) *Attorney, Agent, or Firm* — Lee, Hong, Degerman, Kang & Waimey; Jonathan Kang; Richard Salfelder

(57) ABSTRACT

A circuit breaker includes: a main body housing circuit-breaking parts; a terminal portion exposed outside the main body; a lug-type terminal block attached to the terminal portion and connecting a wire to the terminal portion; and an insulating member provided between the lug-type terminal block and the main body.

8 Claims, 4 Drawing Sheets

(56) References Cited

OTHER PUBLICATIONS

European Patent Office Application Serial No. 14188389.2, Search Report dated Apr. 10, 2015, 7 pages.
Korean Intellectual Property Office Application Serial No. 10-2013-0134335, Notice of Allowance dated May 7, 2015, 2 pages.
Korean Intellectual Property Office Application Serial No. 10-2013-0134335, Office Action dated Aug. 20, 2014, 4 pages.
State Intellectual Property Office of the People's Republic of China Application Serial No. 201410637184.2, Office Action dated Apr. 5, 2016, 6 pages.

* cited by examiner

CIRCUIT BREAKER TERMINAL SHIELD

CROSS-REFERENCE TO RELATED APPLICATION

Pursuant to 35 U.S.C. §119(a), this application claims the benefit of earlier filing date and right of priority to Korean Application No. 10-2013-0134335, filed on Nov. 6, 2013, the contents of which is hereby incorporated by reference herein in its entirety.

BACKGROUND OF THE INVENTION

1. Field of the Invention

The present invention relates to a circuit breaker, and more particularly, to a circuit breaker including a lug-type terminal block.

2. Background of the Invention

In general, a circuit breaker is an electrical device that manually opens and closes an electrical circuit by a handle, or that protects load devices and circuits by detecting an abnormal current such as a short current or a fault current and automatically breaking the circuits.

The circuit breaker normally maintains a conductive status when a rated current flows, but performs a breaking operation when a fault current occurs. To this end, a fixed contact and a moving contact maintain a closed status when a normal current flows.

However, when a fault current has occurred, a trip unit detects the fault current and transmits a signal to a switching mechanism. Then, the switching mechanism is released. Once the switching mechanism is released, the fixed contact and the moving contact are separated from each other. Accordingly, the circuit breaker is able to safely break the accident current.

The circuit breaker includes an arc suppressor on one side of the switching mechanism. The arc suppressor blows out and suppresses an arc generated when the fixed contact and the moving contact are separated from each other.

The circuit breaker is divided into a surface-type terminal block, a reversible terminal block, a plug-in type terminal block, and a lug-type terminal block, depending on the connecting method of a terminal block for connecting the wire of a power supply side and the wire of a load side.

The lug-type terminal block is usually used in the U.S. market.

FIG. 1 is a perspective view showing a conventional circuit breaker using a lug-type terminal block. FIG. 2 is a cross-sectional view taken along the line I-I of FIG. 1.

Hereinafter, the conventional circuit breaker using a lug-type terminal block will be described below with reference to the accompanying FIGS. 1 and 2.

That is, a main body 20 is placed within an outer casing 10 of the conventional circuit breaker.

A mechanism (not shown) including a fixed contact 40 and a moving contact 30, an arc suppressor 24, a trip unit (not shown), etc are mounted within the main body 20 for circuit breaking purposes.

A terminal portion 42 is formed on an end of the fixed contact 40 so as to be exposed to the exterior of the main body 20. A lug-type terminal block 50 for connecting the terminal portion 42 and a wire (not shown) is attached to the terminal portion 42.

The bottom side of the lug-type terminal block 50 is in contact with the terminal portion 42, and one side thereof is positioned facing the main body 20.

However, the lug-type terminal block 50 is positioned in proximity to the outer surface 22 of the arc suppressor 24 in the main body, so that the distance between them is fairly small. As such, an arc conduction path may be formed between the lug-type terminal block 50 and the arc suppressor 24 of the main body 20. Accordingly, dielectric breakdown might occur to the terminal portion through the lug-type terminal block in the main body.

Taking this into consideration, the terminal portion 42 and the lug-type terminal block 50 may be spaced far from the main body 20. In this case, dielectric breakdown can be suppressed. However, this requires increasing the size of the circuit breaker, thus leading to a rise in manufacturing costs and imposing limitations on installation space.

SUMMARY OF THE INVENTION

Therefore, an aspect of the present invention is to provide a circuit breaker which is capable of suppressing the occurrence of dielectric breakdown by forming an arc conduction path between a lug-type terminal block and a main body, without increasing the size of the circuit breaker.

To achieve these and other advantages and in accordance with the purpose of this specification, as embodied and broadly described herein, there is provided a circuit breaker including: a main body housing circuit-breaking parts; a terminal portion exposed outside the main body; a lug-type terminal block attached to the terminal portion and connecting a wire to the terminal portion; and an insulating member provided between the lug-type terminal block and the main body.

The lug-type terminal block may be in as close proximity as possible to the main body as long as the lug-type terminal block does not come into contact with the main body, in order to reduce the size of the circuit breaker.

The insulating member may be supported on at least either the lug-type terminal block or the main body.

The insulating member may include an insulating surface that is formed to cover a side of the lug-type terminal block facing the main body.

According to one embodiment of the present invention, the insulating member may further include a supporting surface that extends from the insulating surface and is inserted between the terminal portion and the lug-type terminal block.

According to another embodiment of the present invention, the insulating member may further include a supporting surface that extends from the insulating surface and is inserted between the terminal portion and the main body.

According to yet another embodiment of the present invention, the side of the lug-type terminal block may include: a first side facing the main body in parallel; and a second side extending from the first side and facing the main body at a slant.

The first side may be in as close proximity to the main body as possible as long as the first side does not come into contact main body.

The distance from the second side to the main body may become smaller as the second side gets nearer to the first side and larger as the second side gets farther from the first side.

The insulating surface of the insulating member may include: a first insulating surface that covers the first side; and a second insulating surface that extends from the first insulating surface and covers the seconds surface.

The insulating member may further include a supporting surface that extends from the first insulating surface and is inserted between the terminal portion and the lug-type terminal block.

Alternatively, the insulating member may further include a supporting surface that extends from the first insulating surface and is inserted between the terminal portion and the main body.

The insulating member may be made of insulating paper. The insulating paper may be Nomex paper.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Hereinafter, an exemplary embodiment of the present invention will be described with reference to the accompanying drawings.

Figure 1:
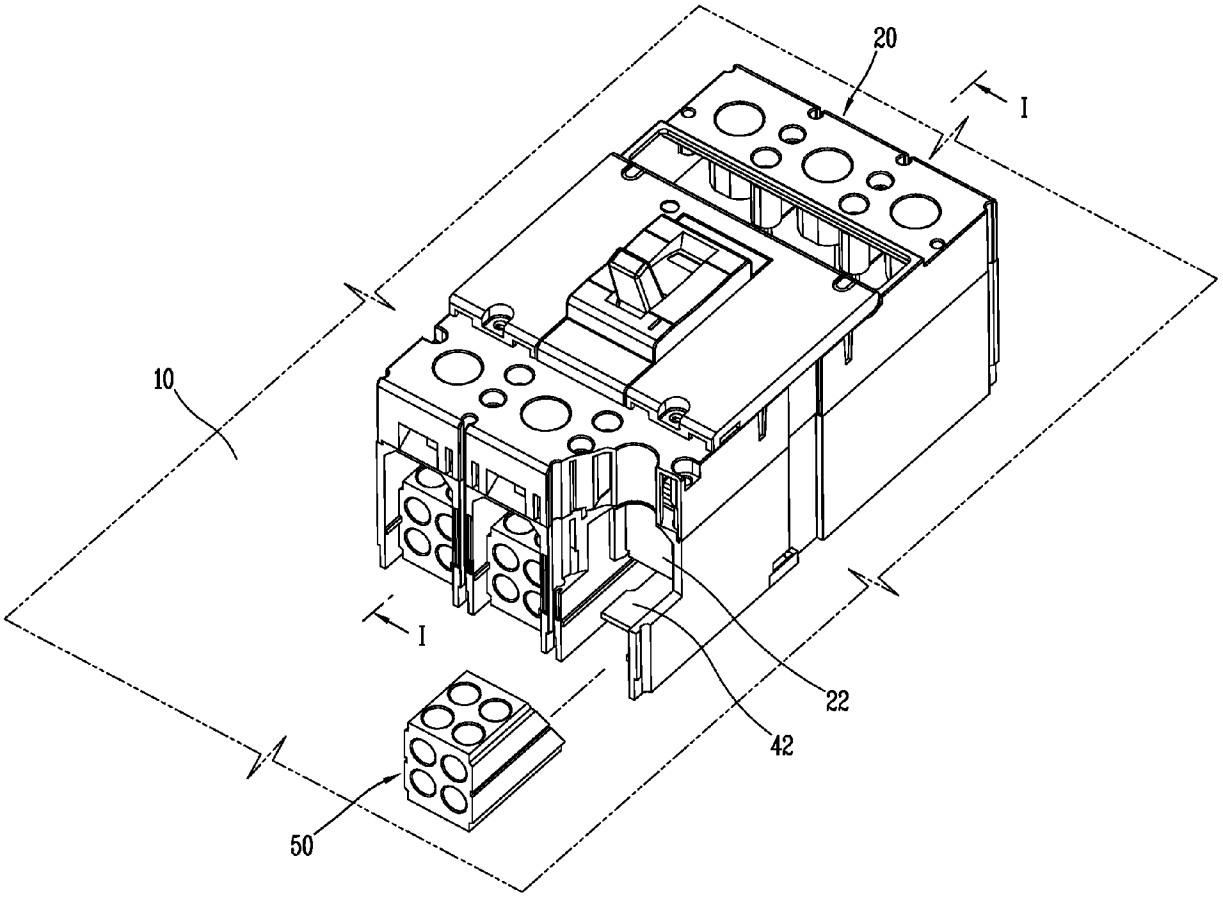
FIG. 1 CONVENTIONAL ART
FIG. 1 is a perspective view showing a conventional circuit breaker.
Figure 2:
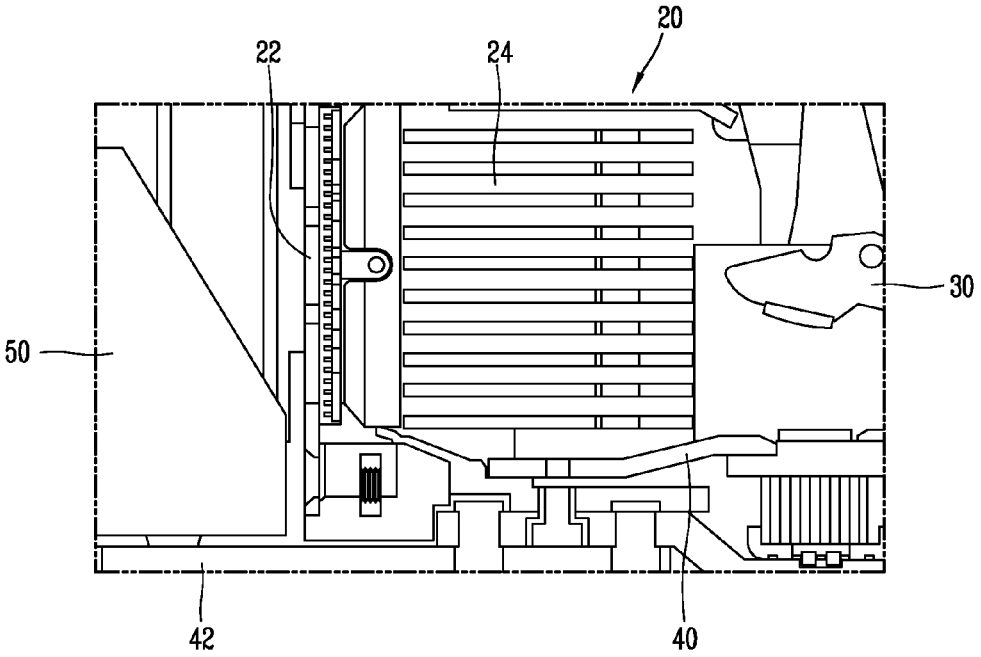
FIG. 2 CONVENTIONAL ART
FIG. 2 is a cross-sectional view taken along the line I-I of FIG. 1.
Figure 3:
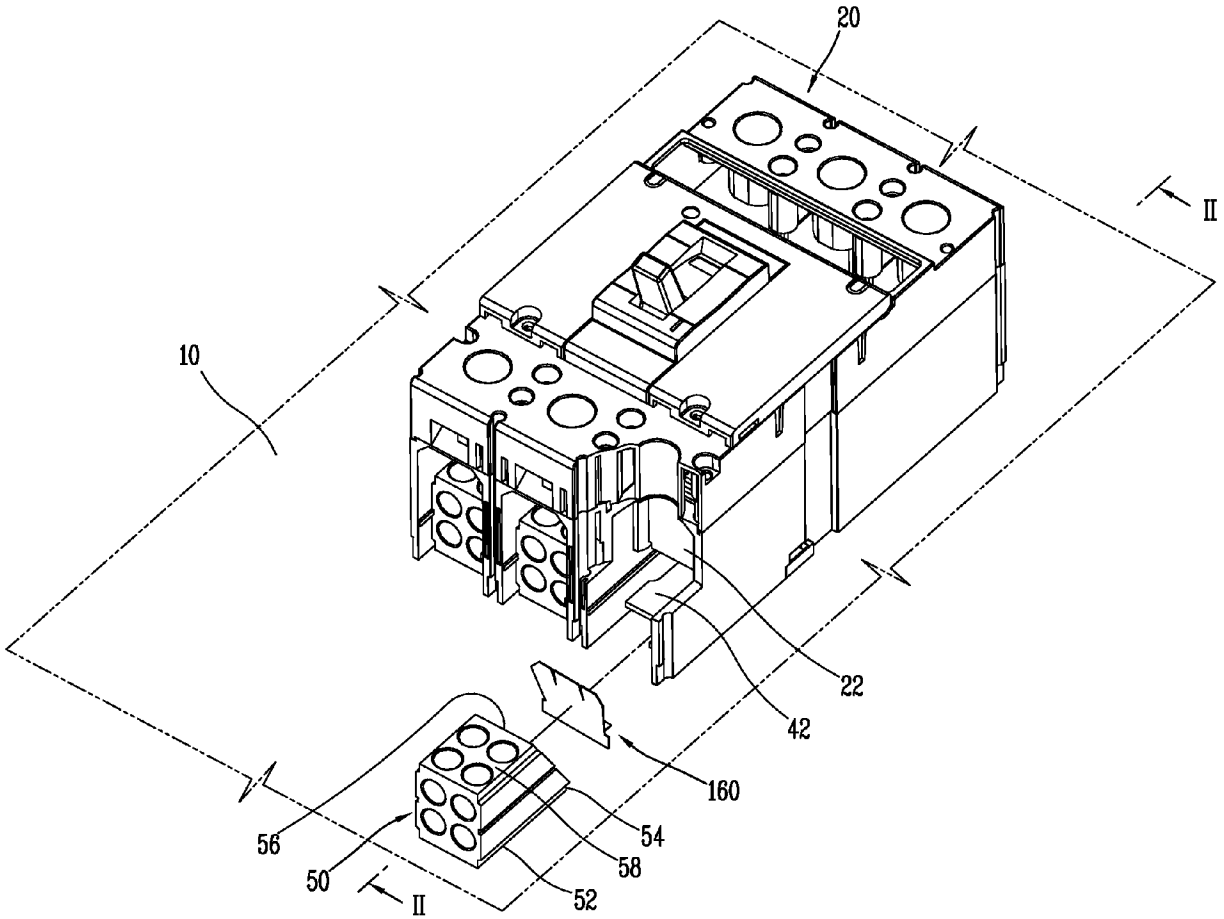
FIG. 3 is a perspective view showing a circuit breaker according to the present invention.
Figure 4:
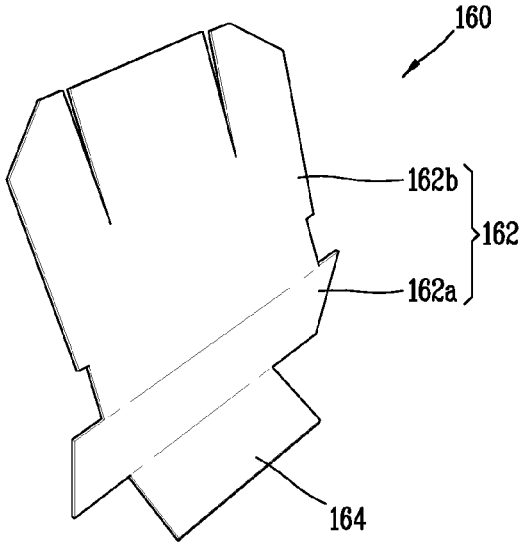
FIG. 4 is a perspective view showing an insulating member of FIG. 3.
Figure 5:
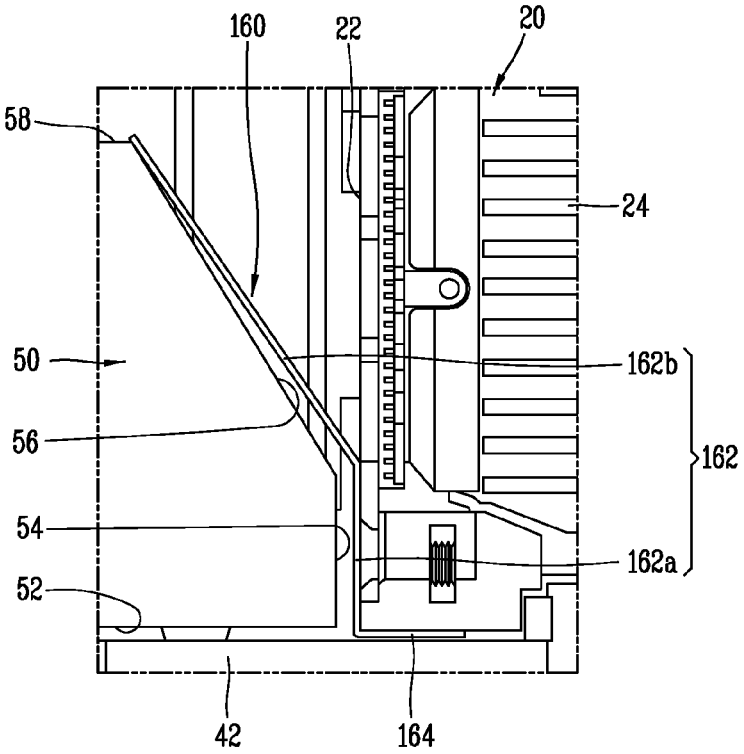
FIG. 5 is a cross-sectional view taken along the line II-II of FIG. 3.

FIG. 3 is a perspective view showing a circuit breaker according to the present invention. FIG. 4 is a perspective view showing an insulating member of FIG. 3. FIG. 5 is a cross-sectional view taken along the line II-II of FIG. 3.

As shown in FIGS. 3 to 5, the circuit breaker according to the present invention may include: a main body 20 housing circuit-breaking parts; a terminal portion 42 exposed outside the main body 20; a lug-type terminal block 50 attached to the terminal portion 42 and connecting a wire to the terminal portion 42; and an insulating member 160 provided between the lug-type terminal block 50 and the main body 20.

The main body 20 may house the circuit-breaking parts and be placed within an outer casing 10.

The circuit-breaking parts include a switching portion (not shown) having a fixed contact 40 and a moving contact 30, an arc suppressor 24 for suppressing an arc generated from the switching portion (not shown), and a trip unit (not shown) for detecting an overload or momentary current and a short current. They are well known components and thus detailed descriptions will be omitted.

The terminal portion 42 may be formed on an end of the fixed contact 40 exposed to the exterior of the main body 20.

The lug-type terminal block 50 for connecting the terminal portion 42 and a wire (not shown) may be attached to the terminal portion 42.

The lug-type terminal block 50 may be in the shape of a rectangle with a sloped side at an edge portion.

With reference to the drawings, the edge portion may be a region where a back side perpendicular to the bottom side 52 and a top side 58 facing the bottom side 52 meet.

For convenience of explanation, the back side of the lug-type terminal block is referred to as a first side 54, and the sloped side is referred to as a second side 56.

The bottom side 52 of the lug-type terminal block 50 may be in contact with the terminal portion 42, and the first side 54 and the second side 56 may be positioned facing the outer surface 22 of the arc suppressor in the main body.

The first side 54 may be in as close proximity to the outer surface 22 of the arc suppressor in the main body as possible as long as it does not come into contact with the outer surface 22 of the arc suppressor in the main body, and may be positioned parallel to the outer surface 22 of the arc suppressor in the main body.

The second side 56 may be slanted to the outer surface 22 of the arc suppressor in the main body. In other words, the distance from the second side 56 to the outer surface 22 of the arc suppressor in the main body may become larger as it goes from the first side 54 toward the top side 58.

The reason why the lug-type terminal block 50 includes the second side 56, the first side 54 is positioned adjacent to the outer surface 22 of the arc suppressor in the main body, and the second side 56 is inclined to the outer surface 22 of the arc suppressor in the main body is to make the circuit breaker as small in size as possible and facilitate the blowout of an arc.

More specifically, the outer surface 22 of the arc suppressor in the main body may include an arc outlet at the top facing the second side 56 to blow out an arc.

The lug-type terminal block 50 may be positioned in as close proximity to the main body 20 as possible as long as it does not come into contact with the main body 20, in order to make the circuit breaker as small in size as possible.

However, if the lug-type terminal block 50 is positioned in proximity to the main body 20, the top of the lug-type terminal block 50 where the top side 58 is positioned may block the arc outlet because the lug-type terminal block 50 has a predetermined height from the bottom side 52 to the top side 58. Accordingly, an arc may not be properly blown out.

As such, the lug-type terminal block 50 may be positioned in as close proximity to the main body 20 as possible in order to make the circuit breaker as small in size as possible, and may include the second side 56 at the part facing the arc outlet to properly blow out an arc.

The insulating member 160 may be positioned between the lug-type terminal block 50 and the main body 20 to suppress dielectric breakdown caused by an arc conduction path formed between the lug-type terminal block 50 and the arc suppressor 24 of the main body 20.

The insulating member 160 may include an insulating surface 162 that is formed to cover the side facing the outer surface 22 of the arc suppressor in the main body of the lug-type terminal block 50.

Moreover, the insulating member 160 may include a supporting surface 164 that is bent and extends from the insulating surface 162 and is inserted between the terminal portion 42 and the main body 20.

In this case, the insulating member 164 may be made of insulating paper, such as Nomex paper.

In this embodiment, the insulating member 160 may include the supporting surface 164, and the supporting surface 164 may be inserted between the terminal portion 42 and the main body 20. As such, the insulating member 160 may be supported on the main body 20.

Alternatively, the supporting surface 164 may be inserted between the terminal portion 42 and the bottom side 52 of the lug-type terminal block 50, and therefore the insulating may be supported on the lug-type terminal block 50.

Alternatively, the insulating member 160 may include only the insulating surface 162 but not the supporting surface 164, and the insulating surface 162 may be attached to the side facing the outer surface 22 of the arc suppressor in the main body of the lug-type terminal block 50 and supported on the lug-type terminal block 50.

The insulating surface 162 may include a first insulating surface 162*a* that covers the first side 54 of the lug-type terminal block 50 and a second insulating surface 162*b* that is bent and extends from the first insulating surface 162*a* and covers the seconds surface 56 of the lug-type terminal block 50.

In this case, the supporting surface 164 may be bent and extends from the first insulating surface 162*a* to the opposite side of the second insulating surface 162*b*.

In these drawings, the same components as those in the prior art are given the same reference numerals.

Now, operational effects of the circuit breaker according to the present invention will be described.

That is, when a rated current flows, the circuit breaker normally maintains a conductive status, keeping the moving contact 30 and the fixed contact 40 in contact with each other.

However, when an abnormal current, such as a fault current, occurs, the circuit breaker performs a breaking operation as the moving contact 30 is separated from the fixed contact 40.

The first side 54 and second side 56 of the lug-type terminal block 50 are positioned in proximity to the outer surface 22 of the arc suppressor in the main body, so that the distance between them may be fairly small.

Accordingly, dielectric breakdown might occur due to an arc conduction path formed between the lug-type terminal block 50 and the arc suppressor 24 in the main body 20.

On the other hand, in the circuit breaker according to the present invention, the insulating member 160 made of an insulating material may be positioned between the lug-type terminal block 50 and the main body 20, more precisely, between the first and second sides 54 and 56 of the lug-type terminal block 50 and the outer surface 22 of the arc suppressor in the main body.

As such, the circuit breaker according to the present invention can suppress the formation of an arc conduction path between the lug-type terminal block 50 and the main body 20.

Therefore, the circuit breaker according to the present invention can suppress dielectric breakdown occurring to the terminal portion 42 through the lug-type terminal block 50 in the main body 20, without increasing the size of the circuit breaker.

As a consequence, the circuit breaker according to the present invention can suppress incomplete arc suppression and improve the reliability of circuit breaking.

What is claimed is:

1. A circuit breaker comprising:

a main body housing circuit-breaking parts;

a terminal portion exposed outside the main body;

a lug-type terminal block attached to the terminal portion and connecting a wire to the terminal portion; and an insulating member provided between the lug-type terminal block and the main body, wherein the lug-type terminal block is in as close proximity as possible to the main body as long as the lug-type terminal block does not come into contact with the main body, in order to reduce the size of the circuit breaker, wherein the insulating member comprises an insulating surface that is formed to cover a side of the lug-type terminal block facing the main body, wherein the side of the lug-type terminal block comprises:

a first side parallel to and facing the main body; and a second side extending from the first side and facing the main body at a slant, the first side being in as close proximity to the main body as possible as long as the first side does not come into contact with the main body and a distance from the second side to an outer surface of an arc suppressor in the main body becoming smaller as the second side gets nearer to the first side.

2. The circuit breaker of claim 1, wherein the insulating member is supported on at least either the lug-type terminal block or the main body.

3. The circuit breaker of claim 1, wherein the insulating member further comprises a supporting surface that extends from the insulating surface and is inserted between the terminal portion and the lug-type terminal block.

4. The circuit breaker of claim 1, wherein the insulating member further comprises a supporting surface that extends from the insulating surface and is inserted between the terminal portion and the main body.

5. The circuit breaker of claim 1, wherein the insulating member is made of insulating paper.

6. The circuit breaker of claim 1, wherein the insulating surface of the insulating member comprises:

a first insulating surface that covers the first side; and a second insulating surface that extends from the first insulating surface and covers the second sides.

7. The circuit breaker of claim 6, wherein the insulating member further comprises a supporting surface that extends from the first insulating surface and is inserted between the terminal portion and the lug-type terminal block.

8. The circuit breaker of claim 6, wherein the insulating member further comprises a supporting surface that extends from the first insulating surface and is inserted between the terminal portion and the main body.

* * * * *